United States Patent [19]

Rich, Jr.

[11] 4,364,822

[45] Dec. 21, 1982

[54] AUTOGENOUS HEAVY MEDIUM PROCESS AND APPARATUS FOR SEPARATING COAL FROM REFUSE

[76] Inventor: John W. Rich, Jr., Gilberton Coal Co., Gilberton, Pa. 17934

[21] Appl. No.: 279,627

[22] Filed: Jul. 1, 1981

Related U.S. Application Data

[63] Continuation-in-part of Ser. No. 253,401, Apr. 13, 1981, abandoned.

[51] Int. Cl.[3] ..... B03B 5/34; B04C 5/081

[52] U.S. Cl. ..... 209/3; 209/172.5; 209/211; 209/11

[58] Field of Search ..... 209/11, 211, 172.5, 209/3; 210/512.1

[56] References Cited

U.S. PATENT DOCUMENTS

| | | | |
|---|---|---|---|
| 2,312,706 | 3/1943 | Freeman | 92/28 |
| 2,373,635 | 4/1945 | Wuensch | 241/20 |
| 2,377,524 | 6/1945 | Samson et al. | 92/28 |
| 2,649,963 | 8/1953 | Fontein | 209/211 |
| 2,701,641 | 2/1955 | Krijgsman | 209/172.5 |
| 2,723,750 | 11/1955 | Pickens et al. | 209/211 |
| 2,724,503 | 11/1955 | Fontein | 209/211 |
| 2,726,765 | 12/1955 | Rakowsky | 209/211 |
| 2,754,963 | 7/1956 | Krijgsman et al. | 209/12 |
| 2,819,795 | 1/1958 | Fontein et al. | 209/211 |
| 2,860,252 | 11/1958 | Dijkstra | 250/53 |
| 2,870,908 | 1/1959 | Fitch | 209/211 |
| 2,932,395 | 4/1960 | Marot | 209/172.5 |
| 2,949,190 | 8/1960 | Pagnotti et al. | 209/172.5 |
| 3,031,074 | 4/1962 | Osawa | 209/12 |
| 3,093,577 | 6/1963 | Wilmot | 209/172.5 |
| 3,114,510 | 12/1963 | McCarty et al. | 241/34 |
| 3,130,157 | 4/1964 | Kelsall et al. | 209/211 X |
| 3,206,917 | 9/1965 | Kaiser et al. | 55/41 |
| 3,207,310 | 9/1965 | Yesberger | 209/155 |
| 3,353,673 | 11/1967 | Visman | 209/211 |
| 3,379,308 | 4/1968 | Horiuchi | 209/172.5 |
| 3,389,793 | 6/1968 | Leeman | 209/211 |
| 3,541,593 | 11/1970 | Weston | 209/211 |
| 3,735,869 | 5/1973 | Carpenter et al. | 209/211 |
| 3,799,341 | 3/1974 | Papworth | 209/172.5 |
| 3,887,456 | 6/1975 | Loughner | 209/211 |
| 3,926,787 | 12/1975 | Gay | 209/211 X |
| 4,090,956 | 5/1978 | Benzon | 209/211 |
| 4,164,467 | 8/1979 | Liller | 209/10 |
| 4,175,036 | 11/1979 | Frykhult | 209/211 |
| 4,203,831 | 5/1980 | Parnaby | 209/13 |
| 4,224,143 | 9/1980 | Liller | 209/211 |
| 4,226,708 | 10/1980 | McCartney | 209/211 |
| 4,252,639 | 2/1981 | Smith et al. | 209/5 |

FOREIGN PATENT DOCUMENTS

| | | |
|---|---|---|
| 506108 | 9/1954 | Canada . |
| 666801 | 8/1949 | United Kingdom . |
| 2046630 | 3/1980 | United Kingdom . |

OTHER PUBLICATIONS

*Coal Preparation,* 3rd Ed., Leonard et al., Eds., American Institute of Mining, Metallurgical, and Petroleum Engineers, Ch. 10, 1968.

"Coal Mining and Processing", Feb., 1981, p. 19.

*Primary Examiner*—Ralph J. Hill

*Attorney, Agent, or Firm*—Howson and Howson

[57] ABSTRACT

Coal is separated from mining refuse utilizing an autogenous non-magnetic heavy medium and one or more cyclonic separators. In the process, raw input from mine tailings is screened and mixed with heavy medium to form an aqueous slurry feedstock. The feedstock slurry flows through a primary cyclonic separator which causes a coal-rich portion to exit its overflow and a refuse-rich portion to exit its underflow. The coal-rich overflow is dewatered to produce clean coal solids and a water-rich underflow slurry. The refuse-rich underflow from the primary cyclone is dewatered to produce solid refuse particles and one portion of the heavy medium. Another portion of the heavy medium is obtained by the underflow from the coal-rich slurry dewatering equipment. The primary cyclone has a cylindrical section with an axial extent greater than its inside diameter for imparting to tangentially-admitted feedstock slurry a substantially constant acceleration followed immediately by increasing acceleration in a depending conical portion. A vortex finder depends to about the middle of the cylindrical chamber for exhausting the coal-rich overflow slurry therefrom, and the refuse-rich underflow slurry is discharged through a bottom orifice. If desired, the refuse-rich underflow from a dewatering cyclone located downstream of the primary cyclone can be crushed and recycled through the primary cyclone to separate middlings.

45 Claims, 5 Drawing Figures

REFUSE
COAL
RAW INPUT
110
111
112
113
115
116
117
118
119a
119b
120
121
122'
122a
122b
122"
123
124
125
126
127
128
129
130
131
132
133
136
137
138
140
141
142
143
145
146
155
160
161
170
171
172'
173
174
175
180
C1
C2
C3
C4
M1
M2

AUTOGENOUS HEAVY MEDIUM PROCESS AND APPARATUS FOR SEPARATING COAL FROM REFUSE

CROSS-REFERENCE TO RELATED APPLICATION

The present application is a continuation-in-part of copending application Ser. No. 253,401 filed on Apr. 13, 1981, now abandoned, for Autogenous Heavy Medium Process And Apparatus For Separating Coal From Refuse.

FIELD OF THE INVENTION

The present invention relates to methods and apparatus for separating coal from refuse. More particularly, the present invention relates to methods and apparatus utilizing an autogenous heavy medium and cyclonic separators to separate coal from associated refuse.

BACKGROUND OF THE INVENTION

In the earlier part of this century, substantial quantities of anthracite coal were mined and processed in breakers to produce coal of various sizes. The coal was separated from mining refuse, and huge mounds of tailings were produced. Such tailings are currently being produced from active mining operations. Mine tailings are known to contain varying amounts of coal and refuse. For instance, a typical mound may contain 20–40% coal. Because of the steep rises in energy costs which have occurred within the last decade, it is now economically feasible to process these tailings to separate the coal from the refuse.

Processes are known for separating coal from refuse. One such process, which is practiced widely in this country, is the so-called heavy media cyclone separation process. In this process, separation takes place in a cyclonic separator which creates centrifugal forces which operate in conjunction with a slurry of a predetermined specific gravity to achieve separation.

The specific gravity of the medium is controlled by adding finely-pulverized magnetite ore to screened tailings to form a feedstock slurry which is admitted to the cyclonic separator. Utilizing known principles, the separator produces an overflow which is coal-rich and an underflow which is rich in refuse. The coal-rich overflow is dewatered and is rinsed with fresh water to produce a clean coal output and a magnetite-rich underflow slurry. The underflow slurry from the cyclonic separator is also dewatered and rinsed with fresh water to produce a refuse-rich reject material and a magnetite-rich underflow. The magnetite-rich underflow from both the coal-rich and refuse-rich dewatering screens are then passed through magnetic separators which separate the magnetite ore from its water carrier. The ore-less water than flows into a sump, and the separated ore is returned to a sump upstream of the cyclonic separator for admixing with more tailings and recirculation to the cyclonic separator.

While the thus-described prior art heavy media process functions satisfactorily, it has certain disadvantages. For instance, although the magnetic separators are intended to prevent losses of magnetite, substantial losses of magnetite result from the inherent limitations of the magnetic separators. Because of these limitations, it is not uncommon for magnetite ore losses to average 2½ pounds per ton of raw input. Considering the fact that hundreds of tons of raw input per day can be processed in a typical plant, magnetite losses at current prices can run as high as $72,000/yr., based on 100 tons of input per hour. Thus, it should be apparent that magnetite-enriched heavy medium cyclonic separation techniques are not economical.

Other disadvantages of the magnetite-enriched heavy medium cyclonic separation process include the requirement of a substantial amount of fresh water, a significant capital investment for the magnetic separators, pumps, piping, and ancillary equipment, and a substantial ongoing outlay for operating and maintaining the equipment.

A magnetite-enriched heavy medium cyclonic separation process is disclosed in U.S. Pat. No. 2,726,763. Coal separation processes which use other types of medium are disclosed in U.S. Pat. Nos. 2,701,641; 2,649,963; 2,726,763; 2,860,252; 3,031,074; 2,819,795; 4,203,831; and 4,252,639. Separating cyclones are disclosed in one or more of the preceding patents and the following U.S. Pat. Nos. 2,724,503; 3,353,673; 4,164,467; 3,887,456; 4,175,036; 4,226,708; 3,379,308; and 3,902,601. For further information relating to coal-refuse separation processes, reference is hereby made to the disclosure contained in Chapter 10, entitled Wet Concentration of Fine Coal, of the book entitled *Coal Preparation* by Seeley W. Mudd published in 1968.

OBJECTS OF THE INVENTION

With the foregoing in mind, a primary object of the present invention is to overcome the limitations of known prior art methods and apparatus for separating coal from associated refuse in mine tailings.

It is another object of the present invention to provide an improved heavy medium coal separation process which does not require the use of magnetite ore.

A further object of the present invention is to provide a novel coal separation process which reduces fresh water requirements and is, therefore, environmentally desirable.

Yet another object of the present invention is to provide a heavy medium coal separation process which functions with a minimum of equipment, manpower, and maintenance to separate coal from refuse.

A still further object of the present invention is to provide a process and apparatus for separating relatively large size coal (about "nut" size) from refuse using a cyclonic separator and a non-magnetic heavy medium.

SUMMARY OF THE INVENTION

More specifically, the present invention provides improved processes for separating coal from associated refuse in mine tailings. In the processes, raw tailings input, which may comprise about 20–40% coal by weight, is screened to a size range of at least about ¼"×0 and up to about 2"×0 depending on processing equipment used. For smaller input sizes, a heavy medium slurry preferably flows over the input during screening and then into a sump where it mixes with the screened input to form a feedstock slurry which is pumped to a primary cyclonic separator. The coal-rich overflow slurry from the primary separator is dewatered in either of two disclosed circuits to produce a coal product and a fine particle slurry. The refuse-rich underflow slurry produced by the primary cyclonic separator is dewatered and the dewatered underflow is mixed with the fine particle slurry to produce the heavy medium slurry. The heavy medium slurry combined with the raw input forms the aqueous feedstock slurry as noted above. For anthracite coal, the specific gravity of the heavy medium is controlled within a range of about 1.10 to about 1.40. For separating a large size range of input (2"×0) best results are obtained using a primary cyclonic separator of a particular design. A smaller size range of input ($\frac{1}{4}$"×0) can be separated in a cyclonic separator having a substantially cylindrical shape. Certain preferred operating conditions for the processes, preferred apparatus for practicing the processes, as well as an optional middlings separation process are also disclosed.

BRIEF DESCRIPTION OF THE DRAWINGS

The foregoing and other objects, features and advantages of the present invention should become apparent from the following description when taken in conjunction with the accompanying drawings, in which.

BRIEF DESCRIPTION OF MAGNETITE-ENRICHED METHOD AND APPARATUS

Figures 1, 2:
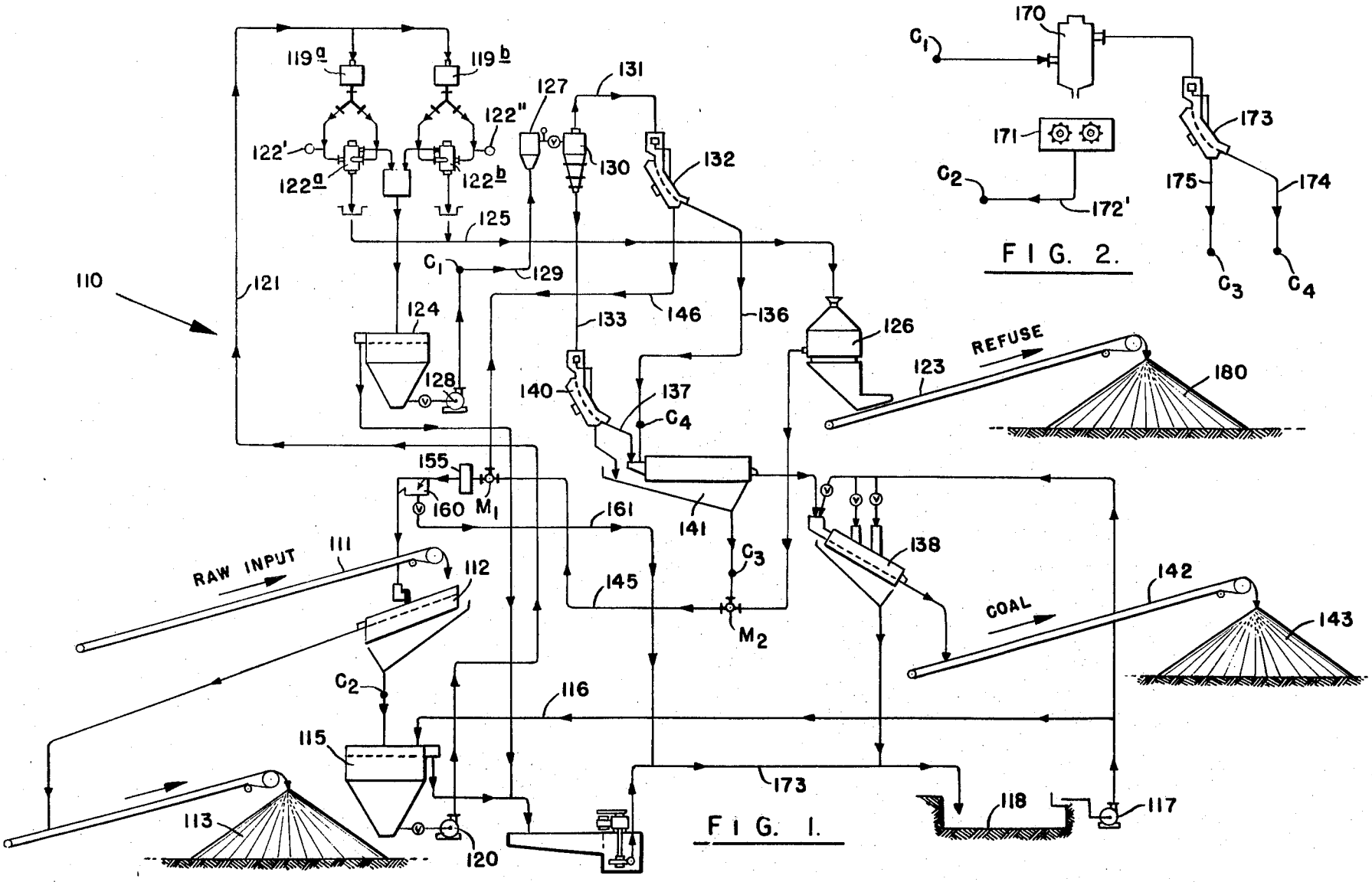
FIG. 1 is a schematic diagram of one of the preferred coal separation processes and apparatus of the present invention.
FIG. 2 is a schematic diagram of an optional middlings-separating portion of the process of the present invention.

In a typical conventional coal separation process utilizing a magnetite-enriched heavy medium and cyclonic separators, raw input from a tailings reserve comprising about 20–40% coal, and the balance refuse, is supplied via a conveyor to a screen which separates the input into a −28 mesh cut which reports via piping either to flotation cells, conventional dryers, or tailings pond, etc. The overfeed from the screen reports to a sump in which a slurry is formed by introducing liquid from a supply pipe along with magnetite ore. The supply pipe is connected via a header to a pump which in turn is connected to settling apparatus.

The magnetite-enriched slurry is flowed from the sump via piping to a cyclonic separator having an overflow and an underflow. The separator is of the increasing-acceleration, or tapered configuration, i.e. tapering outwardly along a substantial portion of its length upward from its underflow orifice and having a small included cone angle. The separator overflow is connected by piping to a sieve bend screen, the overflow from which reports to a 28 mesh dewatering screen and the underflow from which reports to a header connected to the sump. The vibrating dewatering screen has two sections: a drain section and a rinse section. The overfeed from the screen reports to a conveyor which deposits +28 mesh clean coal onto a pile. The underflow from the rinse section of the dewatering screen is fed into a magnetic separator which separates the magnetite ore from the fresh wash water admitted into that section. The magnetite ore is returned to the sump. Water is returned to the settling apparatus.

The refuse-rich slurry from the underflow of the cyclonic separator is fed to a vibrating dewatering screen having two sections: a drain section and a rinse section much like the above-mentioned screen. The overfeed from this screen reports to a conveyor which deposits the refuse-rich dewatered refuse of +28 mesh onto a refuse pile. The underflow from the rinse section of the screen is fed to a magnetic separator for removing the magnetite ore from the ore-rich wash water. The magnetite ore is then returned to the sump, and the water from the separator is fed to the settling apparatus.

The underflows from the drain sections of the two screens are mixed and also returned to the sump.

In processing anthracite coal mine tailings, the specific gravity of the magnetite-enriched (heavy medium) slurry is periodically sampled and adjusted to maintain its specific gravity at about 1.70. For this purpose, a specific gravity meter is connected upstream of the sump for periodically measuring the specific gravity of the heavy medium slurry flowing to the sump. A bleed circuit may be used in the well-known manner to control the specific gravity of the heavy medium.

The cyclonic separator functions in a well-known manner to separate the lighter specific gravity component of the slurry (which is predominantly coal) from the heavier component of the slurry (which is predominantly refuse). The refuse is known to include inorganic matter such as clay, sand, slate, and the like. The thus-described process has been used to separate coal from hundreds of tons per hour of raw input.

Although every effort is made to recapture the magnetite ore in the magnetic separators, inherent inefficiencies in the ore separation process result in substantial losses of magnetite ore per ton of raw input processed. As a result, the conventional magnetite ore-enriched heavy medium process is not as economical to operate on a day-to-day basis as is desired. Furthermore, this process utilizes a substantial quantity of fresh water which is continuously discharged to a tailings pond. Other limitations include the substantial amount of capital equipment required to operate and maintain the equipment, electrical power required to operate the separators, and the like.

DESCRIPTION OF ONE PREFERRED METHOD AND APPARATUS

The present invention eliminates major disadvantages inherent in the above-described prior art process, and thereby provides an economical yet effective coal separation process. This is because separation is achieved without requiring magnetite ore and magnetic separators. As a result, the process of the present invention can be operated with less power-intensive capital equipment, less labor, lower maintenance costs, and with less fresh water.

Referring now to the drawings, FIG. 1 illustrates schematically one preferred embodiment of the process of the present invention and apparatus for practicing the process. The process 110 begins with raw input being charged onto the conveyor 111 illustrated to the lower left in FIG. 1. The raw input is obtained from tailings resulting from mining and coal separation activities. A typical pile of tailings comprises coal and refuse, and may comprise 20–40% by weight of coal with balance refuse. As used herein, the term coal is intended to mean anthracite coal, and the term refuse is intended to mean a variety of inorganic matter such as rocks, shale, slate, clay, and the like which is mined along with the coal.

The term "mesh" used throughout refers to the Tyler standard.

The raw input on the conveyor 111 reports to a vibrating sizing screen 112 which separates the input into an overfeed of $+\frac{1}{4}''$ which is transferred to a pile 113. The $-\frac{1}{4}''\times 0$ raw input reports to a sump 115 where it is mixed with heavy medium and make-up water supplied by a pipe 116. The pipe 116 is connected to a pump 117 which, in turn, is connected to a settling pond 118.

Cyclonic separating means is used to effect the coal-refuse separation. To this end, the inlet of a pump 120 is connected to the sump 115, and the outlet from the pump 120 is connected via piping 121 to flow distribution boxes 119*a* and 119*b* and thence to a bank of cyclonic separators such as the separators 122*a* and 122*b*. Preferably, the separators 122*a* and 122*b* are of cylindrical, or constant acceleration type, i.e., hydrocyclones, wherein the feedstock is admitted tangentially into a shell having a cylindrical shape throughout its length. Because of the cylindrical shape a substantially constant acceleration is imparted to the solids as they circulate in the chamber at any given radius. A typical hydrocyclone of this type is disclosed in U.S. Pat. No. 4,090,956. A cylindrical type of cyclone is to be contrasted with a tapered, or variable acceleration type wherein the shell has a depending frustoconical or tapered portion of substantial length and a relatively small included cone angle. Because of the conical shape, the acceleration forces increase on the particles as they circulate and advance toward the underflow apex. A cyclone 130 of this type is manufactured by Krebs Engineers of Menlo Park, Calif.

Preferred hydrocyclones 122*a* and 122*b* used in this one of the disclosed processes each have a cylindrical shell with an inside diameter $D_1$ and a pair of tangential inlets for causing the feedstock to travel in a circular path under substantially constant acceleration therein. Each hydrocyclone preferably has an axial chamber length of about L, a central tubular vortex finder with an inside diameter of about $D_2$ depending into the shell from one end, and an exit orifice with an inside diameter $D_4$ located in the other end axially opposite the vortex finder with an entrance thereto tapering at a 60° included angle $\alpha$ from an upwardly facing axial shoulder having a diameter D. Each inlet has a cross-sectional area $A_1$. One preferred hydrocyclone (*a* 20" hydrocyclone) has the following dimensions: $D_1$—20"; L—24"; $D_2$—8"; $D_4$—3.5"; D—8.25"; and $A_1$—6.5 in$^2$. Another preferred hydrocyclone (a 14" hydrocyclone) has the following dimensions: $D_1$—14"; L—22"; $D_2$—6"; $D_4$—2.25"; D—5.5"; and $A_1$—3.125 in$^2$.

The coal-rich overflow from the separators 122*a* and 122*b* is conflowed into a sump 124, and the refuse-rich underflow from the separators 122*a* and 122*b* reports via piping 125 to a dewatering unit 126. The solid output from the dewatering unit 126 reports to a conveyor 123 which deposits the refuse in a pile 180. The sump 124 is connected to the inlet of a pump 128, the outlet of which is connected via piping 129 and flow distributor 127 to the inlet of a bank of secondary cyclonic separators, such as the separator 130, for further dewatering. The water-rich overflow from the secondary separator, or dewatering cyclone 130, reports via piping 131 to a static sieve 132. The coal-rich underflow from the dewatering cyclone 130 reports by way of piping 133 to a static sieve 140.

The overfeed from the static sieve 132 and the static sieve 140 reports to a dewatering screen 141, having been supplied via piping 136 and 137, respectively. The overfeed from the dewatering screen 141 reports to a sizing screen 138 where the −35 mesh material is washed by water and the +35 mesh coal reports to a conveyor 142 which conveys the $\frac{1}{4}''\times 35$ mesh clean coal to a pile 143. The underflow from the static sieve 140 and the dewatering screen 141 reports via piping 145 to the sizing screen 112. The underflow from the static sieve 132 reports via piping 146 to the sizing screen 112.

The underflows from the static sieve 132, from the dewatering screens 140 and 141, and from the dewatering unit 126 are conflowed and mixed at locations $M_1$ and $M_2$, and the specific gravity of the conflowed underflows is sampled by a density gauge 155 at a location downstream of the locations $M_1$ and $M_2$ and upstream of the sizing screen 112. The measured density or specific gravity provides the plant operation with a direct specific gravity reading which is used to control accurately the specific gravity of the medium.

In the present invention, the heavy medium is produced in an autogenous manner and comprises fine particulate matter such as clay, slate, rock, coal and the like, and water, and is generated directly from the raw input and is recirculated in the system. In order both to free additional particulate matter from the raw input and to promote screening of the raw input into the sump 115, the underflows collected as noted above are flowed across the raw input on the sizing screen 112. Thus, the feedstock slurry, which comprises the heavy medium and sized raw input, is collected in the sump 115, from which it is pumped to the separating hydrocyclones 122*a* and 122*b* as noted above. It has been found that the thus-generated heavy medium provides the desired density for effective cyclonic separation at a sufficiently low viscosity as to promote cyclonic separation. Furthermore, by operating at lower specific gravities (as contrasted with magnetite-enriched specific gravities) greater flexibility is built into the system to enable it to be used to produce a wider range of coal product.

According to this preferred embodiment of the present invention, the above-described equipment functions efficiently in a continuous manner to separate coal from refuse, provided certain process conditions are observed. For instance, for anthracite coal it is important that the specific gravity of the medium, measured immediately upstream of the sizing screen 112, be maintained at least about 0.35 units below the true specific gravity of the raw coal input. Thus, for anthracite coal having a specific gravity of about 1.75, the specific gravity of the medium should be maintained in a range of about 1.30 to about 1.40, and most preferably about 1.35.

The specific gravity of the medium must be maintained in the forementioned range. This is because if the specific gravity drops below the lower limit of the range, marketable coal reports along with the refuse to the underflow of the cyclonic separators 122*a* and 122*b*, and this is reflected in too low an ash content in the refuse pile. On the other hand, if the specific gravity is too high, too much refuse reports to the overflow of the primary cyclones 122*a* and 122*b*, and this is reflected in too high an ash content in the clean coal output.

The specific gravity of the medium tends to increase after the process has been operating in the steady state for a period of time. In order to control the specific gravity of the medium within the desired range upstream of the primary cyclones 122*a* and 122*b*, the specific gravity of the medium is constantly monitored in the density gauge 155 so that appropriate action can be taken to maintain the specific gravity within the desired range. For instance, if the specific gravity of the medium should increase beyond the desired limit, it can be reduced by bleeding some of the medium out of the system via the valved cushion box 160 and drain 161 located downstream of the density gauge 155, and simultaneously adding fresh water to sump 115 via header 116 to stabilize the specific gravity. If the specific gravity of the medium should drop below the desired lower level, which rarely occurs, it can be increased simply by increasing the fine particulate matter in the feedstock. Thus, the system generates its own medium from fine particulate matter in the input, and this makes it easier to control the specific gravity.

For satisfactory separation, the solids in the feedstock slurry should be maintained in a range of about 10% to about 15%, and most preferably about 12.5% on a weight basis. The term "solids" is intended to mean all +48 mesh material in the feedstock slurry. The operating viscosity should be maintained in a range of about 8 seconds to about 9 seconds, and most preferably about 8.25 seconds on a viscosity scale in which pure water provides a reading of 8 seconds at ambient temperatures.

The temperature of the medium, in the steady state, should be tepid, and a temperature of about 100° F. has been found beneficial. The heat to maintain this temperature is produced autogenously as a result of fluid friction developed during pumping and recirculation of the medium. The heat is beneficial in maintaining the viscosity of the feedstock slurry, and its separated components, at a sufficiently low level as to promote efficient separation and dewatering. Since the heat is generated autogenously, there is no need for special heat exchangers or other equipment to maintain the desired operating temperature.

The process requires a minimum of energy. This is because the separation is achieved at relatively low specific gravities and relatively low pressures. For example, in tests using a 20" diameter hydrocyclone having the dimensions discussed above, satisfactory separation has been achieved with a pressure at each inlet location 122' and 122" in a range of about 4 to about 6 psig. In such tests, the volumetric flow rate through the 20" hydrocyclone at an inlet pressure of 4 psig. was about 441 gpm., resulting in a throughput of about 13.5 tons per hour based on 10% solids in the feedstock slurry. Because the density of the circulated feedstock in this process is less than the density of the feedstock in the magnetite-enriched separation process, and the cyclone inlet pressures are lower, the power required to pump the slurries is less, and there is less wear on pumps, piping, etc.

Tests have demonstrated the efficiency of the process of the present invention in separating coal from raw input obtained from a tailings settling pond. In one group of tests, a 100 gram sample of the raw input was obtained and analyzed for size distribution and ash content. The distribution percentages retained on the stated screen sizes were based on the total weight of the sample and were as follows: 3/32"—0.7%; 3/64"—7.9%; 1/32"—10.2%; 35 mesh—11.6%; 48 mesh—16.8%; 100 mesh—26.8%; and —100 mesh—26.0%. The composite coal content of the raw input was 32.8%, by weight, based on the weight of the sample. The composite refuse content of the raw input was 67.2%, on the same weight basis.

The above raw input was added to a medium having a specific gravity (Sg) of 1.32 to form a feedstock slurry which was supplied to the above-described 20" diameter constant acceleration hydrocyclone at an inlet pressure of 5–6 psig. A +35 mesh coal product was produced having a 17.6% composite ash content. A refuse product was produced having a composite ash content of 88.0%. In an ASTM Sink-Float test, 2.2% of this refuse floated at a 1.75 Sg.

The size distribution and quality of the coal product produced is set forth below in Table I. The percentages are based on a 100 gram sample. The results were analyzed in accordance with ASTM Stds. which require that the ash content be determined by obtaining a sample, drying and screening the sample utilizing a Rotap shaker and suitable screens, weighing material retained on each screen size, burning one gram of the retained material in a crucible, and weighing the ash remaining after burning.

For purposes of comparison, Column A lists the test results and Column B lists the results from a test using the same raw input in a conventional magnetite ore-enriched separation process.

TABLE I

COMPARISON OF COAL PRODUCTS

| SCREEN SIZE | WEIGHT (gms) | | PERCENT ASH | |
|---|---|---|---|---|
| | A (non-mag) | B (mag.) | A (mon-mag.) | B (mag.) |
| 9/16" | — | — | — | — |
| 5/16" | — | 2.7 | — | 18.5 |
| 3/16" | .7 | 3.6 | 10.4 | 13.9 |
| 3/32" | 3.1 | 7.5 | 10.4 | 10.0 |
| 3/64" | 31.9 | 26.4 | 12.6 | 10.6 |
| 1/32" | 31.1 | 15.4 | 18.3 | 11.0 |
| 35 mesh | 28.9 | 16.5 | 22.6 | 12.2 |
| 48 mesh | 4.3 | 20.5 | 29.5 | 14.7 |
| 100 mesh | — | 7.3 | — | 16.9 |
| −100 mesh | — | .1 | — | — |

The size distribution and quality of the refuse product is set forth below in Table II, based on a 100 gm. sample.

TABLE II

COMPARISON OF REFUSE PRODUCTS

| SCREEN SIZE | WEIGHT (gms) | | PERCENT ASH | |
|---|---|---|---|---|
| | A (non-mag.) | B (mag.) | A (non-mag.) | B (mag.) |
| 9/16" | — | 2.2 | — | 72.9 |
| 5/16" | 1.5 | 14.3 | 82.7 | 82.1 |
| 3/16" | 4.6 | 13.5 | 84.8 | 76.1 |
| 3/32" | 10.1 | 17.5 | 86.2 | 75.5 |
| 3/64" | 30.8 | 20.7 | 88.7 | 74.7 |
| 1/32" | 19.2 | 7.1 | 86.4 | 73.7 |
| 35 mesh | 19.8 | 7.7 | 91.0 | 78.5 |
| 48 mesh | 10.0 | 12.6 | 93.0 | 87.0 |
| 100 mesh | 4.0 | 4.4 | — | 91.4 |
| −100 mesh | — | — | — | — |

The aforementioned ASTM Sink-Float test was conducted on another split of the 100 gm. refuse sample analyzed above in Table II. The results are set forth below in Table III.

TABLE III

REFUSE PRODUCT SINK-FLOAT ANALYSIS

| SCREEN SIZE | FLOAT A (non-mag.) |
|---|---|
| 3/32" | .1 |
| 3/64" | .3 |

TABLE III-continued

| REFUSE PRODUCT SINK-FLOAT ANALYSIS | |
|---|---|
| SCREEN SIZE | FLOAT A (non-mag.) |
| 1/32" | .4 |
| 35 mesh | .7 |
| 48 mesh | .7 |
| 100 mesh | — |
| −100 mesh | — |

From the above tables, it may be seen that the process of the present invention operates effectively to produce a high quality coal product within a 3/32" to +35 mesh size range. With a composite ash content of 17.6%, the coal product is well within commercially desirable standards which require composite ash percentages below 20%. The relatively high composite ash content of the refuse indicates that relatively little coal is reporting to the refuse pile. Furthermore, the ash content of the portion of the sample which floated in the Sink-Float test indicates that relatively little good quality coal is reporting to refuse.

Like test results have been obtained utilizing the above raw input in a medium having an Sg. of 1.30 supplied to the above described 14" diameter cylindrical hydrocyclone at a pressure of 5 psig. The test yielded a +35 mesh coal product having a 16.5% composite ash content and a refuse product having a composite ash content of 80.8%. The cyclone handled a throughput in a range of 6 to 10 tons per hour.

In like tests in the same 14" hydrocyclone at 4 psig., wherein the specific gravity of the medium was maintained at 1.35 for two runs, a +35 mesh coal product having an average composite ash content of 18.0% was produced and a refuse product was produced having an average composite ash content of 80.6%.

While a tapered, or variable acceleration, hydrocyclone may be used in the process of the present invention, there are significant advantages in using the cylindrical, or constant acceleration, type disclosed with a shallow tapered bottom wall. For a 20" diameter cyclone having a 24" chamber length, the bottom wall should have a taper of 20° with respect to horizontal to provide a frusto-conical bottom with a tapered entrance to the underflow orifice, i.e., to provide an included cone angle of 140°. The underflow from such a cyclone has a high solids to liquid ratio, because only about 2 to about 5% of the total throughput of the hydrocyclone exits the underflow, the balance being discharged from the overflow. This minimizes the load on downstream dewatering equipment. Also, the specific gravity of the overflow and the underflow are substantially the same as the specific gravity of the operating medium.

With a tapered cyclone, the underflow has a much lower solids to liquid ratio, and in addition, a media classification occurs in the cyclone. Tests with a tapered cyclone and a feedstock slurry having an inlet specific gravity of 1.30 result in an overflow having a specific gravity of 1.20, and an underflow having a specific gravity in excess of 1.45. With such a high specific gravity in the underflow, it is necessary to wash the underflow refuse through the downstream dewatering equipment in order to release the heavy media carried in the underflow. Furthermore, such cyclones operate at significantly higher inlet pressures, in excess of 10 psig, and this requires greater horsepower and results in increased wear.

The cylindrical hydrocyclone provides additional advantages. For instance, the relatively large diameter underflow orifice is resistant to clogging. As a result, the plant operator need not constantly monitor the configuration of the underflow discharge in order to insure that the unit is operating satisfactorily. Other advantages include the fact that satisfactory results have been achieved within cylindrical hydrocyclones using a raw input having a maximum size of about 5/16"; whereas, the tapered cyclones were found to be limited to processing raw input having a maximum size of about ⅛".

While the process of the present invention functions efficiently to produce a high quality coal product in the ¼"×35 mesh size range, it is readily adapted to producing an even lower ash product. For this purpose, the process of FIG. 1 may be modified to include a middlings circuit. Referring now to FIG. 2, the middlings circuit comprises a cylindrical hydrocyclone 170, like in construction to the hydrocyclones 122*a* and 122*b*. The hydrocyclone 170 is connected to the outlet of the pump 128 at location $C_1$ which may be valved to block flow to the cyclone 130. A crusher 171 is disposed downstream of the hydrocyclone 170 and operates in a well-known manner to crush ¼"×0. The crushed underfeed is fed via piping 172 connected at location $C_2$ upstream of the sump 115.

The overflow from the hydrocyclone 170 is dewatered on a static sieve 173 which passes a −35 mesh material and liquid. The overfeed from the static sieve 173 is fed via piping 174 connected at location $C_4$ to the upstream end of the dewatering screen 141. The underflow from the sieve 173 is fed by piping 175 connected at location $C_3$ and flowed to the sump 115 via the sizing screen 112 and the feed pipe 145 leading thereto.

The middlings circuit functions to separate that portion of the product which is separated in the cyclones 122*a* and 122*b* and which tends to be "bony" coal (part organic matter, part inorganic matter) from the low ash coal (pure organic matter). As a result, an overall lower ash product can be produced without causing any additional organic matter to report to the refuse pile. In the event that the middlings circuit is operated, the distributor 127, dewatering cyclone 130, and dewatering sieves 132 and 140 are not operated.

The middlings circuit which is disclosed in FIG. 2 and which uses a minimum of equipment is made possible because of the use of cylindrical hydrocyclones 122*a* and 122*b* in the primary separation step. With such hydrocyclones, about 98% of the feedstock exits the overflow without any media classification occurring therein. This phenomenon makes possible the separation of middlings as described.

The process and apparatus disclosed herein have been found effective in separating anthracite coal from refuse. Since anthracite coal separation is known to be more difficult than bituminous coal separation, the process and apparatus should be capable of operating even more effectively on bituminous coal. While some adjustments in operating conditions will have to be made to compensate for the different specific gravity of bituminous coal, such adjustments should be apparent to those skilled in the art in light of the present disclosure.

DESCRIPTION OF ANOTHER PREFERRED METHOD AND APPARATUS

The method and apparatus described schematically in FIG. 1 is capable of handling raw input which has been screened to a $\frac{1}{4}''\times 0$ size range. While this provides a significant improvement over known processes, a method and apparatus which is capable of separating a wider range of sizes of raw input is highly desirable. To this end, the present invention provides a process and apparatus capable of separating efficiently mine tailings having a $2''\times 0$ size range.

Figure 3:
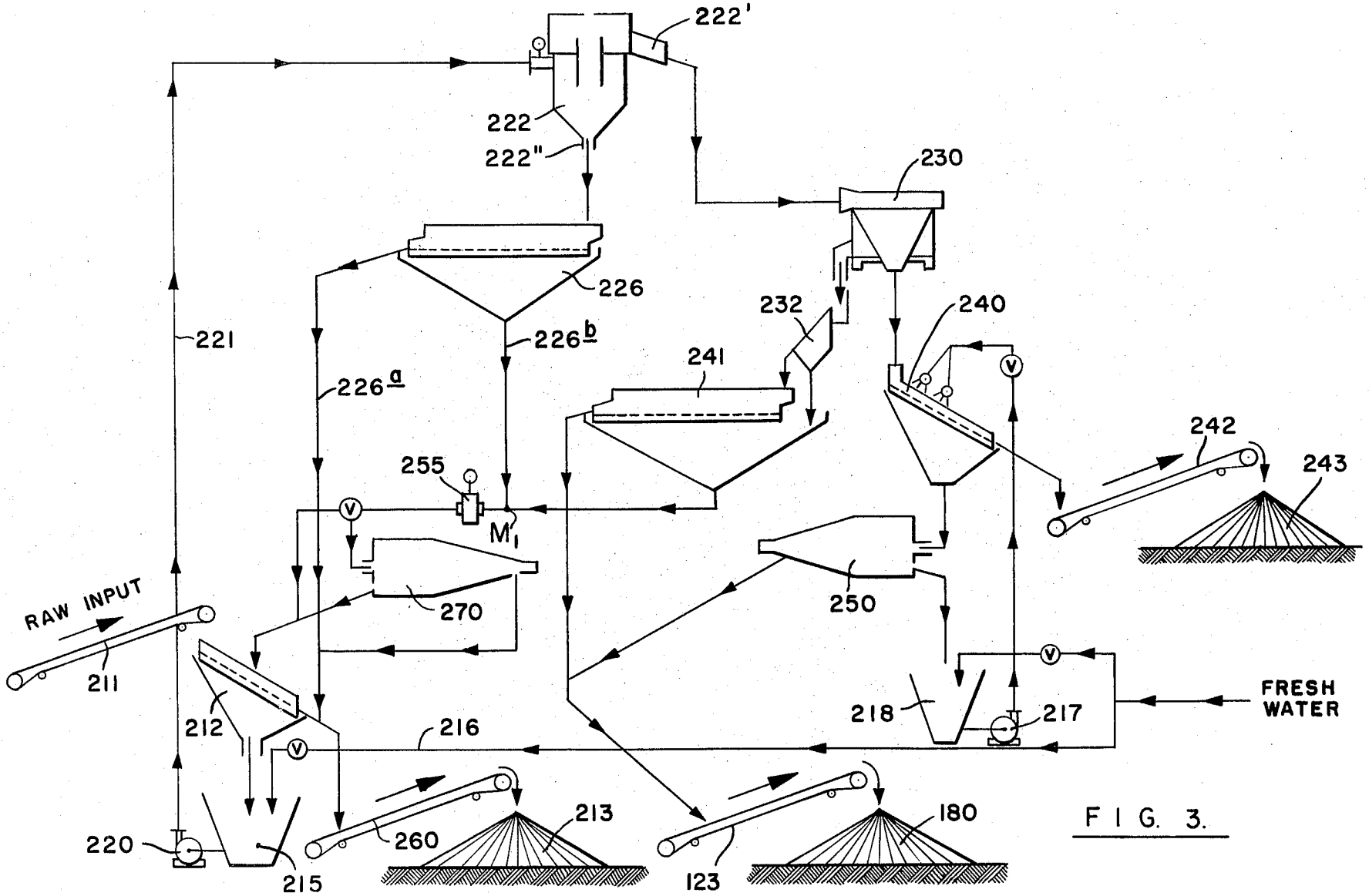
FIG. 3 is a schematic diagram of another of the preferred coal separation processes and apparatus of the present invention.

Referring now to FIG. 3, coarse raw input from mine tailings is supplied via a conveyor 211 to a screen 212 which is dressed with woven wire having a 2" square opening. The plus 2" overfeed from the screen 212 is transported by a conveyor 260 to a pile 213. The $2''\times 0$ input is charged into a sump 215 below the screen 212 from which the input is displaced by a pump 220 and piping 221 to a cyclonic separator 222 which, depending on desired capacity, may be connected in parallel with like separators, such as in the manner illustrated in FIG. 1.

The separator 222 functions in a manner to be described to produce a coal-rich overflow slurry which exits a lateral outlet 222' and a refuse-rich overflow slurry which exits an apex orifice 222".

The refuse-rich slurry is fed to a dewatering screen 226. The overfeed from the dewatering screen 226 is fed via channel **226*a* to the conveyor 260 for deposit on the refuse pile 213. The underflow from the dewatering screen 226 is fed via piping 226*b* to a location $M_1$ immediately upstream of a density gauge 255**.

The coal-rich overflow from the cyclonic separator 222 is fed into a frusto-conical rotary sieve 230, such as sold under the trade designation VOR-SEIVE by National Standard Co. of Carbondale, Pa. to separate all +35 mesh coal from the overflow slurry. The underflow from the rotary sieve 230 passes onto a sieve 232, the overfeed from which is fed onto a screen 241 and the underfeed from which by-passes the screen 241 and is collected in its underflow bay. The underflow from the screen 241 is fed via piping to the location $M_1$ where it merges with the underflow from the dewatering screen 226. The overfeed from the screen 241 is channeled to a conveyor 123 which dumps the material on a flotation-feed pile 180.

The coal exiting the bottom of the rotary sieve 230 is fed to a vibrating screen 240 to separate any remaining −35 mesh coal particles. The overfeed is fed to a conveyor 242 for deposit onto a clean coal pile 243. The underflow from the sieve 240 is fed to a centrifugal dryer 250, such as manufactured by Bird Machine Co. of South Walpole, Mass. The dryer 250 produces a solid overfeed of fine particles which are fed to the conveyor 123 and thence to the pile 180. The dryer 250 also produces a water-rich slurry which is fed to a sump 218 from which it is supplied via pump 217 to the sprayers associated with the sieve 240. A certain amount of make-up water may be supplied to the sump 218 from a fresh water supply. In addition, a certain amount of fresh water may be supplied to the sump 215 via piping 216.

In order to assist in controlling the specific gravity of the medium, a centrifugal dryer 270, like the dryer 250, is connected downstream of the density gauge 255. The purpose of the dryer 270 is to allow a high-density medium to be withdrawn from the heavy medium circuit without affecting the volume of water in the circuit. The solid fraction (−48 mesh×5 microns) exits from the tapered end of the dryer 270 and is supplied to the conveyor 260 for deposit on the pile 213. The liquid fraction exits from the base end and is flowed onto the screen 212 to assist in washing fines through the screen 212 and in maintaining the proper level of fluid in the sump 215 and in the heavy medium circuit.

This process has certain advantages. For instance, the Bird centrifugal separators 250 and 270 are capable of separating from a slurry a solids fraction down to five microns in size. As a result, essentially all of the water utilized in the process can be retained and recirculated. Thus, only sufficient make-up water is required to compensate for water evaporated or otherwise lost in the process, and this amounts to little more than the difference between the moisture content of the raw input and the moisture content of the product and refuse produced. Accordingly, the process is particularly desirable from an environmental standpoint since the process can be self-contained and operated with minimal fresh water requirements and without discharging any noxious effluents.

The cyclonic separator 222 is designed specifically to be used with a heavy medium to separate coal from refuse in a raw input size range as large as about $2''\times 0$. Thus, while the process illustrated schematically in FIG. 3 is capable of handling coal and refuse of a $2''\times 0$ size range, should it be desired to handle raw input of a maximum $\frac{1}{4}''\times 0$ size range, the cyclone 222 could be replaced with one or more cyclones of the design illustrated in FIG. 1. Alternatively, should it be desired to enable the process illustrated in FIG. 1 to handle a wider size range of raw input ($2''\times 0$) the cyclone 222 illustrated and described with respect to FIG. 3 could be substituted for the cyclones 122 illustrated and described with respect to FIG. 1.

Figure 4:
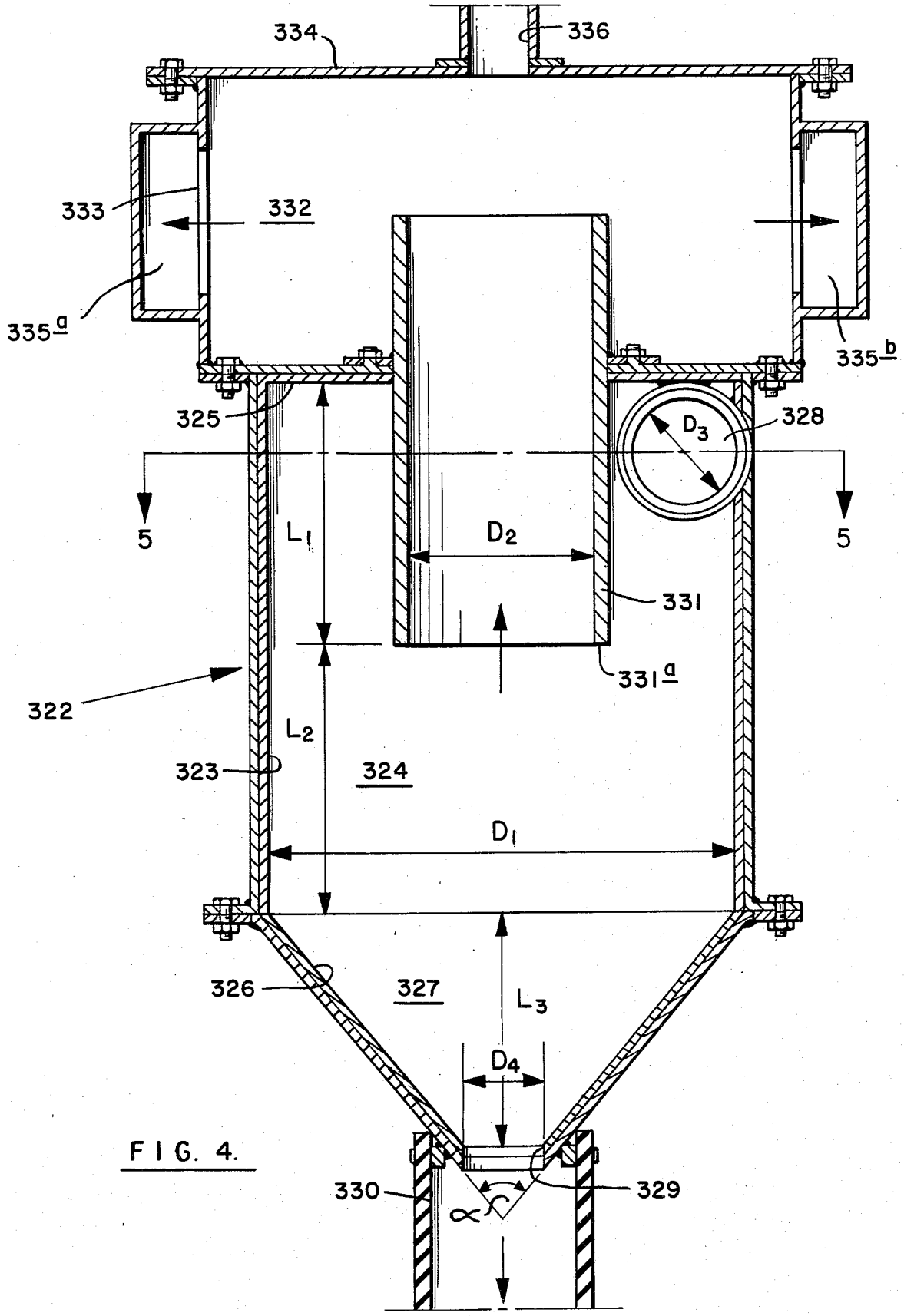
FIG. 4 is a longitudinal sectional view of a preferred cyclonic separator.
Figure 5:
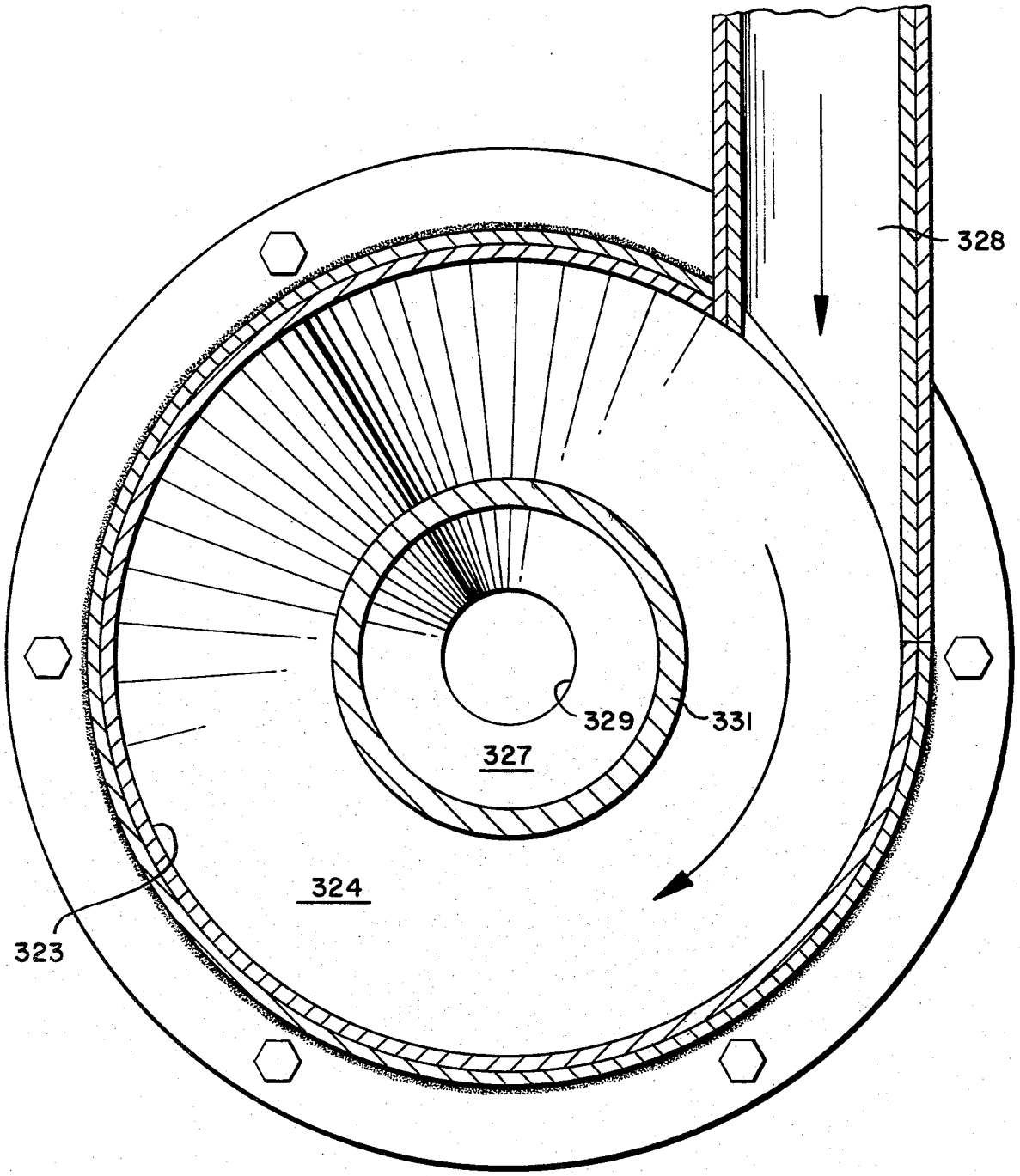
FIG. 5 is a sectional view taken on line 5—5 of FIG. 4.

The cyclonic separator 222 is well suited for use in the processes illustrated schematically in FIGS. 1 and 3. To this end, the separator 222 (designated 322 in FIGS. 4 and 5) comprises a wall 323 which forms a cylindrical chamber 324. The upper end of the chamber 324 is closed by a transverse end wall 325. The lower end of the chamber 324 is closed by a tapered or frusto-conical end wall 326 which forms a tapered chamber 327 immediately below and in fluid communication with the cylindrical chamber 324. A tangential inlet 328 is provided in the cylindrical chamber 324 adjacent its upper end wall 325 (FIG. 4) and an outlet orifice 329 is provided in the apex of the tapered bottom wall 326. A flexible boot is clamped around the apex orifice 329 to limit splashing.

A tubular vortex finder 331 depends into the chamber 324 and terminates slightly above the middle of the chamber 324. The vortex finder 331 also projects into a plenum 332 having lateral discharge outlets **335*a* and 335*b*. An observation port 336 aligned with the vortex finder 331 and the apex orifice 329 is provided above the plenum 332**.

Tests have revealed that the separator 322 must be constructed in accordance with certain dimensional relations if optimum separation is to be achieved under prescribed operating conditions. For instance, the inside diameter $D_1$ of the chamber 324 should be slightly smaller than the combined axial extent of the chamber 324 as determined by the sum of lengths $L_1$ and $L_2$. The vortex finder 331 should depend into the chamber 324 and have a lower edge **331*a* which terminates slightly above the midpoint of the chamber 324 as indicated by the dimension $L_1$. The inside diameter $D_2$ of the vortex finder 331 should be dimensioned to provide a cross-sectional area which corresponds to about 1/6 of the cross-sectional area of the chamber 324 measured below the vortex finder. The included cone angle $\alpha$ of the tapered bottom wall 326 should be in a range of about 90° to 140°, and preferably 100°. The diameter $D_3$ of the inlet 328 should be larger than the diameter $D_4$ of the outlet orifice 329**, and both should be smaller than the inside diameter of the vortex finder.

By way of example, and not by way of limitation, the cyclonic separator should have the following dimensions: $L_1$—11"; $L_2$—12"; $D_1$—20"; $D_2$—8"; $D_3$—4"; $D_4$—3½"; and angle $\alpha$ of 100° if satisfactory separation of coarse raw input is to be achieved under certain operating conditions.

Tests have been conducted on a cyclonic separator 322 having the above-noted configuration and dimensions. The tests have revealed that the separator 322 is capable of separating coal from refuse in coarse raw input having a size range of about 2"×0 using a non-magnetic heavy medium having a specific gravity lower than the coal being separated and supplied at certain flow rates. While the precise manner in which the separator 322 operates cannot be fully explained, it is believed that the constant and variable acceleration forces in the cylindrical and tapered chambers combine with a certain lifting action generated by currents adjacent the vortex finder to provide the desired separation.

In one particular test, raw input screened to a size range of 1⅞"×0 was entrained in a non-magnetic heavy medium and supplied as feedstock to the inlet 328 of the cyclonic separator 322 at a static pressure of 8 psig. The specific gravity of the medium prior to entrainment of the raw input was maintained at 1.20. The solids to water ratio, as defined heretofore, was maintained at about 15%. The separator should, however, be capable of handling a solids to water ratio of 20%. The flow rate of the feedstock was maintained at about 450 gpm. The results of the test are set forth in Table IV below.

TABLE IV

| SCREEN SIZE | COAL | | REFUSE | |
|---|---|---|---|---|
| (in.) | WT. (gms) | ASH (%) | WT. (gms) | ASH (%) |
| 13/16 | 51.0 | 9.2 | 49.3 | 88.8 |
| 9/16 | 26.8 | 6.2 | 25.4 | 86.2 |
| 5/16 | 7.8 | 5.4 | 21.1 | 80.7 |
| 3/16 | .8 | 6.4 | 3.1 | 77.5 |
| 3/32 | .6 | 7.7 | .5 | 80.0 |
| 3/64 | 2.5 | 11.5 | .2 | 65.6 |
| 1/32 | 2.5 | 15.9 | .1 | — |
| 35 (mesh) | 3.6 | 19.8 | .1 | — |
| −35 (mesh) | 4.4 | 30.5 | — | — |

From the above table it may be seen that the separator produced a substantial amount of a relatively low ash coal product simultaneously with a relatively high ash refuse product, particularly at the upper end of the size range, i.e., with respect to the +9/16" size range. Like results were achieved in other tests using the same inlet pressures and flow rates at specific gravities of 1.15 and 1.25. Good results should be obtainable at an Sg. of 1.10.

A similar test was run using the same separator with a raw input having a narrower size range of ¼"×0, a medium having a specific gravity of 1.20, an inlet pressure of 8 psig., and the same flow rate. The results are set forth below in Table V.

TABLE V

| SCREEN SIZE | COAL | | REFUSE | |
|---|---|---|---|---|
| (in.) | WT. (gms) | ASH (%) | WT. (gms) | ASH (%) |
| 5/16 | | | .8 | |

TABLE V-continued

| SCREEN SIZE | COAL | | REFUSE | |
|---|---|---|---|---|
| (in.) | WT. (gms) | ASH (%) | WT. (gms) | ASH (%) |
| 3/16 | .3 | | 15.8 | 80.9 |
| 3/32 | 1.7 | 10.3 | 22.1 | 93.7 |
| 3/64 | 21.9 | 12.1 | 66.1 | 81.3 |
| 1/32 | 29.2 | 15.1 | 40.5 | 83.9 |
| 35 (mesh) | 38.5 | 19.1 | 45.0 | 87.1 |
| −35 (mesh) | 8.4 | 26.9 | 14.7 | 92.0 |

From the above table, it may be seen that the separator again produced excellent coal and refuse products with a narrower range of raw input. Like results were obtained in another run with a medium having a specific gravity of 1.25. Other tests with coarse input (1⅞"×0) at higher pressures (9–14 psig.), at lower pressures (5 psig. and below), with a shallower bottom wall (120° included cone angle) and at specific gravities ranging from about 1.20 to about 1.30 and at like flow rates did not provide the same high quality coal and refuse products of Tables IV and V, particularly when the chamber and vortex lengths were 4" longer than those stated in the example.

In view of the foregoing, it should be apparent that the present invention now provides improved methods and apparatus for separating coal from refuse resulting from mining operations. The separation can be achieved without requiring expensive magnetite ore and over a relatively wide ranges of sizes. Furthermore, separation can be effected with a minimum of capital equipment, power requirements, and maintenance costs.

While preferred methods and apparatus have been described in detail, various modifications, alterations and changes may be made without departing from the spirit and scope of the present invention as defined in the appended claims.

I claim:

1. A process for separating coal from raw input which includes coal and refuse, comprising the steps of:

screening the raw input to produce solids having a size range of about 2"×0;

admixing said solids with a non-magnetic heavy medium to form a feedstock slurry having a solids content of at least about 10%;

cyclonically separating said feedstock slurry to produce a coal-rich slurry and a refuse-rich slurry;

said cyclonic separating step including the steps of:

admitting said feedstock slurry tangentially into a substantially cylindrical chamber for subjecting said feedstock to substantially constant acceleration through a first axial extent, immediately thereafter admitting said feedstock slurry into a tapered chamber in fluid communication with said cylindrical chamber to subject said feedstock slurry to increasing acceleration through a second axial extent corresponding to about one-half said first axial extent, exhausting said coal-rich slurry in one direction from said cylindrical chamber through a vortex finder depending centrally into said cylindrical chamber a distance less than about one-half said first axial extent, and discharging said refuse-rich slurry in the opposite direction through an orifice in said tapered chamber aligned axially with said vortex finder, dewatering the coal-rich slurry to produce a coal product and a fine coal slurry;

dewatering said refuse-rich slurry to produce a refuse product and a fine refuse slurry;

mixing said fine coal and fine refuse slurries together to form said non-magnetic heavy medium;

maintaining the specific gravity of the medium prior to introduction of said raw input below a predetermined specific gravity determined by the coal product to be prepared;

whereby coal is separated from refuse in a continuous process utilizing an autogenous non-magnetic heavy medium.

2. The process according to claim 1 wherein said specific gravity of said medium differs from said coal product by at least about 0.35 units.

3. The process according to claim 1 wherein said desired coal product is anthracite, and said specific gravity of said medium is controlled within a range of about 1.10 to about 1.40.

4. The process according to claim 1 wherein said feedstock slurry has a solids content in a range of about 10% to about 20% of the total weight of the feedstock slurry, said solids consisting of +48 mesh material in said feedstock slurry.

5. The process according to claim 1 wherein said fine coal and fine refuse slurries provide substantially the entire heavy medium required for said cyclonic separating step.

6. The process according to claim 1 wherein said zone of increasing acceleration is provided by a tapered wall located between the bottom of said chamber and said orifice and having an included cone angle in a range of about 90° to about 140°.

7. The process according to claim 1 wherein said substantially cylindrical chamber has a diameter in a range of about 14" to 20" and an axial length in a range of about 22" to 24", said vortex finder has an inside diameter in a range of about 6" to 8", and said orifice has a diameter in a range of 2.25" to 3.5".

8. The process according to claim 1 wherein said feedstock slurry is supplied to said inlet at a static pressure in a range of about 6 to about 8 psig. and is admitted into said substantially cylindrical chamber at a volumetric flow rate in a range of about 300 to 500 gpm.

9. The process according to claim 1 wherein said fine coal and fine refuse slurries are flowed together at one location, and the specific gravity of the conflowed slurries is measured downstream of said one location, said one location being prior to introduction of raw input to said medium to form said feedstock.

10. The process according to claim 9 wherein said mixed slurries are flowed onto said sizing screen located downstream of said location where said specific gravity is measured.

11. The process according to claim 1 wherein the viscosity of the feedstock slurry is maintained in a range of about 8 to about 9 seconds upstream of said cyclonic separating step.

12. The process according to claim 11 wherein said viscosity is maintained below about 8.25 seconds.

13. The process according to claim 1 including the step of allowing the medium to increase in temperature to at least about 100° F. to help maintain a relatively low viscosity and to reduce surface tension upstream of said cyclonic separating step.

14. The process according to claim 1 including the steps intermediate said cyclonic separating step and said coal-rich slurry dewatering step of subjecting said coal-rich slurry to a secondary cyclonic separating step to produce an overflow of lower ash coal than said first-mentioned cyclonic separating step and crushing the underflow from said secondary cyclonic separating step and returning said crushed underflow to mix with said medium and raw input.

15. The process according to claim 1 including the step of flowing said heavy medium across said raw input during said screening step to wash raw input, and collecting below said sizing screen said screened and washed raw input with said heavy medium and thereby providing said feedstock slurry.

16. The process according to claim 1 wherein said specific gravity maintaining step includes the steps of measuring the specific gravity of said heavy medium upstream of said sizing screen and bleeding said heavy medium downstream of said measuring location and adding water to said feedstock slurry as needed to control said specific gravity.

17. A process for separating coal from raw input which includes coal and refuse, comprising the steps of:

screening the raw input to produce feed solids having a size range of about 2"×0;

admixing said feed solids with a non-magnetic heavy medium having a specific gravity in a range of about 1.10 to about 1.40 to form a feedstock slurry;

subjecting said feedstock slurry sequentially both to substantially constant acceleration for a predetermined time and then to increasing acceleration in at least one cyclonic separator to produce a coal-rich slurry and a refuse-rich slurry, said feedstock accelerating step including the steps of confining said feedstock slurry in a chamber having a substantially cylindrical shape with a predetermined axial dimension and a conical end wall having an axial extent corresponding to about one-half said predetermined axial dimension to provide said substantially constant acceleration followed by said increasing acceleration, and including the step of exhausting through a vortex finder terminating above the median of said cylindrical chamber said coal-rich slurry and discharging from the apex of said conical end wall the refuse-rich slurry;

dewatering said coal-rich slurry to produce a coal product and a coal-rich underflow slurry;

dewatering said refuse-rich slurry to produce a refuse product and a refuse-rich underflow slurry;

conflowing said coal and refuse slurries to produce a heavy medium;

periodically sampling said heavy medium to determine its specific gravity;

bleeding said heavy medium and adding water to said feedstock slurry as indicated by said sampled specific gravity to adjust the specific gravity of the medium in said range;

whereby coal is separated from refuse in a continuous process.

18. The process according to claim 17 including the step of centrifuging the medium produced in said bleeding step to produce solids and liquid, and admixing said liquid with said heavy medium.

19. The process according to claim 17 wherein said non-magnetic heavy medium circulates continuously in said process and, in the steady state, is generated entirely from the fine solids associated with the raw input.

20. A process for separating coal from raw input which includes coal and refuse, comprising the steps of:

screening the raw input to produce feed solids having a size range of about 2"×0;

admixing said feed solids with a non-magnetic heavy medium to form a feedstock slurry having a solids content of at least about 10%;

maintaining the specific gravity of said heavy medium prior to introduction of said raw input below the specific gravity of the coal to be separated;

cyclonically separating said feedstock slurry to produce a coal-rich overflow slurry having middlings contained therein and a refuse-rich underflow slurry;

said cyclonic separating step including the steps of:

admitting said feedstock slurry tangentially into a substantially cylindrical chamber for subjecting said feedstock to substantially constant acceleration through a first axial extent, immediately thereafter admitting said feedstock slurry into a tapered chamber in fluid communication with said cylindrical chamber to subject said feedstock slurry to increasing acceleration through a second axial extent corresponding to about one-half said first axial extent, exhausting said coal-rich middlings-containing slurry in one direction from said cylindrical chamber through a vortex finder depending centrally into said cylindrical chamber a distance less than about one-half said first axial extent, and discharging said refuse-rich slurry in the opposite direction through an orifice in said tapered chamber aligned axially with said vortex finder, dewatering the coal-rich slurry to produce a coal product and a fine coal slurry;

dewatering said refuse-rich slurry to produce a refuse product and a fine refuse slurry;

admitting said middlings-containing coal-rich overflow into a secondary cyclonic separator to produce a low ash middlings-free overflow and a high ash middlings rich underflow;

crushing said high ash middlings-rich underflow solids to a size range smaller than said screened raw input;

admixing said high ash crushed underflow solids with said feed solids and with said fine coal and fine refuse slurries to form said feedstock slurry; and recirculating said feedstock slurry to said cyclonic separating step.

21. The process according to claim 20 wherein said coal is anthracite and said specific gravity of said medium is maintained below about 1.40 by bleeding said heavy medium prior to said admixing step and adding water to the feedstock slurry as required to maintain said specific gravity below said limit.

22. The process according to claim 20 wherein said secondary cyclonic separating step is performed in at least one hydrocyclone.

23. Apparatus for separating coal from raw input which includes coal and refuse, comprising:

means for screening the raw input to produce solids having a size range of about 2"×0;

means for mixing said solids with a non-magnetic heavy medium to form a feedstock slurry;

means for cyclonically separating said feedstock slurry to produce a coal-rich slurry and a refuse-rich slurry, said cyclonic separating means including a wall forming a substantially cylindrical chamber and a bottom wall forming a tapered chamber adjacent an underflow orifice, said cylindrical chamber having an axial length slightly greater than its inside diameter, said tapered chamber having an axial length corresponding to about one-half the axial length of said cylindrical chamber, and including a vortex finder depending centrally into said cylindrical chamber and terminating above the median thereof and an outlet orifice in said tapered chamber in axial alignment with said vortex finder;

means for dewatering the coal-rich slurry to produce a coal product and a fine coal slurry;

means for dewatering said refuse-rich slurry to produce a refuse product and a fine refuse slurry;

means for mixing said fine coal and fine refuse slurries together to form said non-magnetic heavy medium; and means for feeding said heavy medium to said first-mentioned mixing means to form said feedstock slurry;

whereby coal can be separated from refuse on a continuous basis utilizing an autogenous non-magnetic heavy medium.

24. Apparatus according to claim 23 wherein said feeding means flows said heavy medium across said raw input on said screening means.

25. Apparatus according to claim 23 including means cooperating with said feeding means to measure the specific gravity of said heavy medium before it is flowed into said mixing means.

26. Apparatus according to claim 23 including means connected to said feeding means for bleeding heavy medium therefrom, and means for supplying water to said mixing means.

27. Apparatus according to claim 23 wherein said mixing means includes a hopper disposed below said screening means for collecting said screened raw input and said heavy medium.

28. Apparatus according to claim 23 wherein said cyclonic separating means includes a constant acceleration hydrocyclone having said tapered bottom wall.

29. Apparatus according to claim 23 wherein said first-mentioned dewatering means includes a variable acceleration hydrocyclone.

30. Apparatus according to claim 23 wherein said cyclonic separating means includes primary and secondary cyclonic separators, means for flowing said overflow from said primary cyclonic separator to said secondary separator, means for crushing the underflow from said secondary separator, and means for feeding said crushed underflow to said mixing means.

31. Apparatus according to claim 30 wherein both of said secondary cyclonic separator is of the constant acceleration type.

32. Apparatus according to claim 23 wherein said substantially cylindrical chamber has an inside diameter of about 20", an axial length of about 23", and said bottom wall has an included tapered angle of about 100° from its intersection with said substantially cylindrical chamber wall.

33. Apparatus according to claim 32 wherein said vortex finder depends about 11" into said cylindrical chamber and has about an 8" inside diameter, means providing an inlet tangentially into said cylindrical chamber at the end thereof remote from said orifice, said inlet having a cross-sectional area of about 12.5 in.$^2$ and said orifice having a cross-sectional area of about 9.5 in.$^2$.

34. A process for separating coal and refuse from raw input comprising the steps of:

screening said raw input to a size range of about 2"×0;

entraining said screened raw input in a heavy medium slurry having a specific gravity lower than the specific gravity of the coal to be separated;

admitting said raw input and heavy medium tangentially under pressure through an inlet into a substantially cylindrical chamber having an axial length slightly greater than its diameter to subject said input to a substantially constant acceleration for a predetermined time interval;

causing said raw input to enter a tapered chamber having an included cone angle of about 90° to about 120° at one end of said substantially cylindrical chamber for increasing the acceleration on the raw input;

discharging a refuse-rich slurry through an orifice at the apex of said tapered chamber; and exhausting coal-rich slurry from about the middle of said cylindrical chamber through a vortex finder of a predetermined inside diameter.

35. The process according to claim 34 wherein said coal is anthracite and said specific gravity is maintained in a range of about 1.10 to about 1.40.

36. The process according to claim 34 wherein said pressure is maintained in a range of about 6 to about 8 psig.

37. The process according to claim 34 wherein said heavy medium is substantially free from magnetic particles and including the step of causing at least a portion of said refuse-rich slurry to be recirculated to said inlet for causing substantially all of said heavy medium to be supplied from said raw input during steady state operation of the process.

38. The process according to claim 37 wherein the solids content of the combined raw input and medium slurry is maintained in a range of about 10% to 20% on a weight basis based on the weight of said combined slurry.

39. For use in a process of separating coal and refuse from raw input having a size range of about 2″×0 entrained in a heavy medium slurry having a predetermined specific gravity, a cyclonic separator, comprising:

a wall defining a substantially cylindrical chamber having a predetermined inside diameter;

means providing a transverse end wall at one end of said chamber;

means providing at least one tangential inlet into said chamber adjacent said end wall;

a tapered end wall at the other end of said cylindrical chamber having an included cone angle in a range of about 90° to about 140°;

means providing an orifice in said tapered wall adjacent the apex thereof;

a vortex finder depending into said cylindrical chamber and terminating at about the median thereof; and the inside diameter of said cylindrical chamber being slightly less than its axial length.

40. The separator according to claim 39 wherein said tapered end wall has an axial length corresponding to about one-half the axial length of said substantially cylindrical chamber.

41. The separator according to claim 39 wherein said included cone angle is about 100°.

42. The separator according to claim 41 wherein said vortex finder has an inside diameter slightly less than about one-half the inside diameter of said substantially cylindrical chamber.

43. The separator according to claim 42 wherein the cross-sectional area of the orifice is slightly less than the cross-sectional area of said inlet and both are less than one-half the cross-sectional area of the vortex finder.

44. The separator according to claim 39 wherein said predetermined chamber diameter is about 20″, said axial length of said substantially cylindrical chamber is about 23″, the axial length of said vortex finder measured from said transverse end wall is about 11″, inside diameter of said vortex finder is about 8″, the inside diameter of said inlet is about 4″, and the inside diameter of said orifice is about 3½″.

45. The separator according to claim 44 including means providing an outlet plenum above said chamber in fluid communication with said vortex finder and a port in said plenum above said vortex finder.

* * * * *